US006724287B2

(12) United States Patent
Nadenau et al.

(10) Patent No.: US 6,724,287 B2
(45) Date of Patent: Apr. 20, 2004

(54) ELECTROMAGNET

(75) Inventors: Volker Nadenau, Nuremberg (DE); Thomas Kupfer, Rosstal (DE)

(73) Assignee: Robert Bosch GmbH, Stuttgart (DE)

( * ) Notice: Subject to any disclaimer, the term of this patent is extended or adjusted under 35 U.S.C. 154(b) by 89 days.

(21) Appl. No.: 10/182,943

(22) PCT Filed: Dec. 12, 2001

(86) PCT No.: PCT/DE01/04605

§ 371 (c)(1),
(2), (4) Date: Aug. 2, 2002

(87) PCT Pub. No.: WO02/052586

PCT Pub. Date: Jul. 4, 2002

(65) Prior Publication Data

US 2003/0011453 A1 Jan. 16, 2003

(30) Foreign Application Priority Data

Dec. 22, 2000 (DE) ..... 100 64 488

(51) Int. Cl.[7] ..... H01F 5/00
(52) U.S. Cl. ..... 335/299; 361/198
(58) Field of Search ..... 335/78, 282, 299; 336/137, 144, 192, 198; 251/129.15

(56) References Cited

U.S. PATENT DOCUMENTS 3,568,008 A * 3/1971 Tanimura et al. ..... 361/155
3,663,914 A * 5/1972 Lane ..... 336/192
3,787,792 A * 1/1974 DeJong et al. ..... 336/192
3,975,721 A * 8/1976 Franz ..... 340/458
4,418,720 A 12/1983 Day
4,523,169 A * 6/1985 Hay ..... 336/60
4,617,543 A * 10/1986 Akachi et al. ..... 336/192
4,761,628 A * 8/1988 Nishi et al. ..... 336/180
4,862,123 A 8/1989 Gray
4,888,571 A * 12/1989 Kobayashi et al. ..... 336/65
5,331,298 A * 7/1994 Kameya ..... 333/138
5,694,105 A * 12/1997 Weiner ..... 336/198
6,326,877 B1 * 12/2001 Hay et al. ..... 336/198
6,472,970 B1 * 10/2002 Odmark ..... 336/208
2003/0030531 A1 * 2/2003 Okano et al. ..... 336/198

FOREIGN PATENT DOCUMENTS

EP 0 464 370 A 1/1992
JP 02247932 A * 10/1990 ..... H01H/50/04

* cited by examiner

*Primary Examiner*—Lincoln Donovan
*Assistant Examiner*—Bernard Rojas
(74) *Attorney, Agent, or Firm*—Michael J. Striker

(57) ABSTRACT

In an electromagnet (10) having a magnet coil (13), which has an exciter winding (23) wound from an insulated winding wire (24), having a magnet core (14), having a movable armature (16) opposite the magnet core (14), and having a restoring spring (21) engaging the armature (16), a plurality of meltable stanchions (26) of electrically conductive material that are connected electrically conductively to one another are disposed on the magnet coil (13), for the sake of later calibration of the magnetic force furnished by the completed electromagnet (10). The winding wire (24) is guided around each of the stanchions (26), in selected windings of the exciter winding. To adjust the desired magnetic force, at least two stanchions (26) are melted, so that they form a reliable weld with the winding wire (24), through the wire insulation thereof (FIG. 4).

13 Claims, 2 Drawing Sheets

ELECTROMAGNET

PRIOR ART

Figure 1:
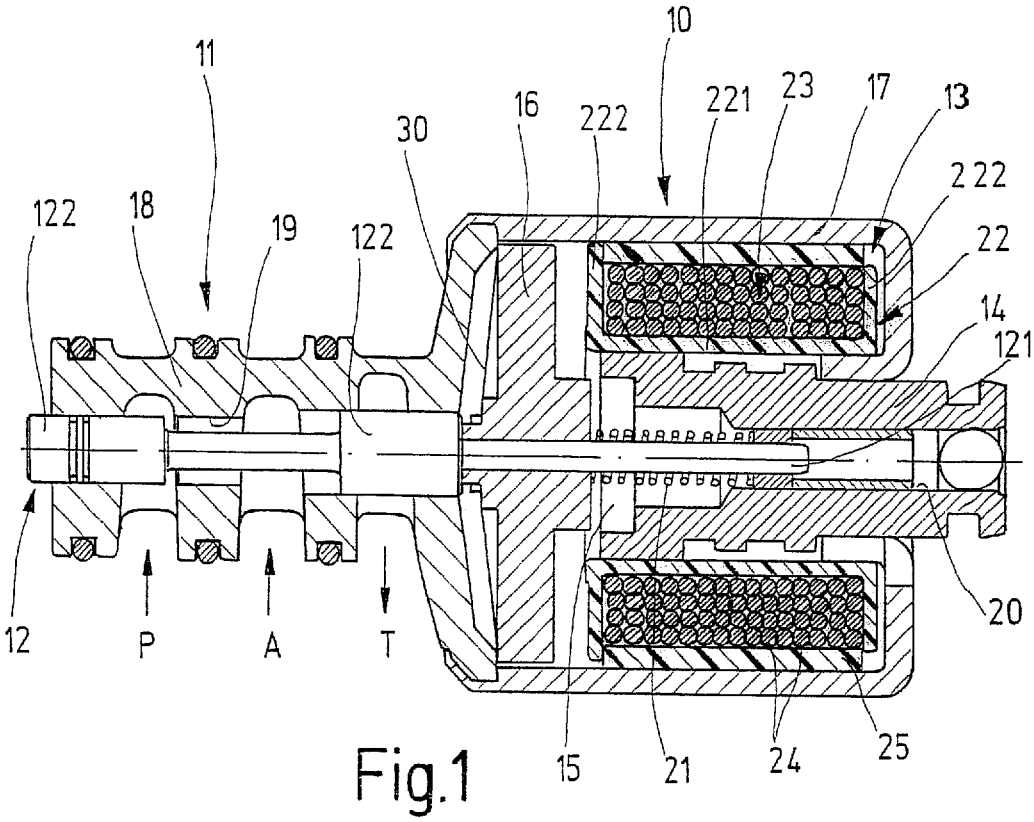

The invention is based on an electromagnet as generically defined by the preamble to claim 1.

In automatic transmissions in motor vehicles, for controlling the transmission actuators embodied as electromagnetically actuated pressure regulating valves are used, in which an electromagnet generates a magnetic force for performing a hydraulic control function. The dependency between the exciter current supplied to the magnet coil and the regulating pressure controlled is described by the characteristic curve of the pressure regulating valve. The characteristic curve has a steady course and is specified and forms the basis for the application in the motor vehicle. One essential characteristic of the characteristic curve is its slope. This slope is determined by the properties of the electromagnet. Fluctuations in the production tolerances of the individual parts of the electromagnet, however, affect the magnetic flux and thus the magnetic force, so that in the characteristic curves of identical actuators of the same production series, major fluctuations in the slope of the characteristic curves can occur.

In a known electromagnetic final control element with a proportional magnet for actuating proportional valves (European Patent Disclosure EP 0 464 370 B1), to eliminate the adverse effect of production variations and differences in permeability of the magnet material on the magnetic force of the proportional magnet and thus on the slope of the valve characteristic curve, technical measures have been taken for varying the magnetic resistance in the magnetic circuit within limits after the assembly of the electromagnet and thus to be able to calibrate electromagnets from the same production series retroactively with respect to their magnetic force. To that end, a displaceable adjusting sleeve of magnetically conductive material is slipped onto the end of a pressure tube, which receives the movable armature and forms part of the ferromagnetic circuit of the electromagnet. By displacing the adjusting sleeve, the overlap between the adjusting sleeve and the pressure tube, and thus the magnetic resistance that counteracts the magnetic flux, can be varied. The amount of the overlap determines the magnitude of the magnetic transitional resistance and thus affects the total resistance. If the overlap is zero or negative, major scattered fluxes occur, and the magnetic force engaging the armature drops considerably.

ADVANTAGES OF THE INVENTION

The electromagnet of the invention having the characteristics of claim 1 has the advantage that to create the capability of calibration for retroactive variation of the magnetic force intrinsic to the completed electromagnet, only minor structural changes to the magnet coil must be provided, while no comparatively major structural changes need to be made in the ferromagnetic circuit of the electromagnet. By welding at least two stanchions, each surrounded by one winding of the exciter winding, with the respective winding portion surrounding the stanchions, the part of the exciter winding located between the two winding portions welded to the stanchions is short-circuited, so that because of the reduced number of windings in the exciter winding, the magnetic force drops. Depending on the number of windings located between two welded-on stanchions, the magnetic force can be decreased to a greater or lesser extent. Since there are a plurality of stanchions and the winding packets located between the stanchions can be embodied with different numbers of windings, it is possible to reduce the magnetic force of the electromagnet with high precision by melting the applicable stanchions in such a way that they weld to the winding wire.

In order also to compensate for production variations that result in a lesser magnetic force than what is demanded, the exciter winding is embodied with a number of windings that is greater than the number of windings required for a magnetic force calculated in advance from the structural design of the electromagnet. Next, on the completed electromagnet, by intentional welding of the appropriate stanchions to the exciter winding, the requisite magnetic force is established. The welding is done by means of a laser beam. In the process, the stanchions melt open and produce a sufficiently large molten volume for secure welding.

By the provisions recited in the other claims, advantageous refinements of and improvements to the electromagnet defined by claim 1 are possible.

In one advantageous embodiment of the invention, one of the stanchions, preferably the stanchion around which the winding wire end is wrapped, is already welded to the winding wire end during the production of the electromagnet, while at least a further one of the other stanchions is not melted, for the sake of calibrating the magnetic force, until after the electromagnet has been completed. This shortens the calibration time, since for calibration purposes one fewer stanchion has to be melted.

In an advantageous embodiment of the invention, the electrical connection between the stanchions is produced by a rib of electrically conductive material, as a result of which the stanchions are combined into a one-piece stanchion strip. Such a stanchion strip can easily be secured to the coil body of the magnet coil, for instance by providing that the rib of the stanchion strip is injection-molded jointly in the production process for the coil body.

In a preferred embodiment of the invention, the rib, in a yarn-reel-like embodiment of the coil body that receives the exciter winding, is injected into one of the coil body flanges that define the exciter winding on its face end, the injection being done in such a way that the stanchions protrude radially from the flange circumference. In an exciter winding wound in multiple layers, the windings that wrap around the stanchions are then located in the uppermost layer in the end region of the exciter winding.

Since the magnet coil is typically surrounded by a housing, in an advantageous embodiment of the invention an opening congruent with the stanchion strip is present in the housing. Through this opening in the housing, access to the radially oriented stanchions on the flange of the coil body is possible. After the calibration operation by welding an appropriate stanchion to the winding portion wrapped around it, the housing opening is closed with a potting composition, preferably epoxy resin.

DRAWING

Figure 2:
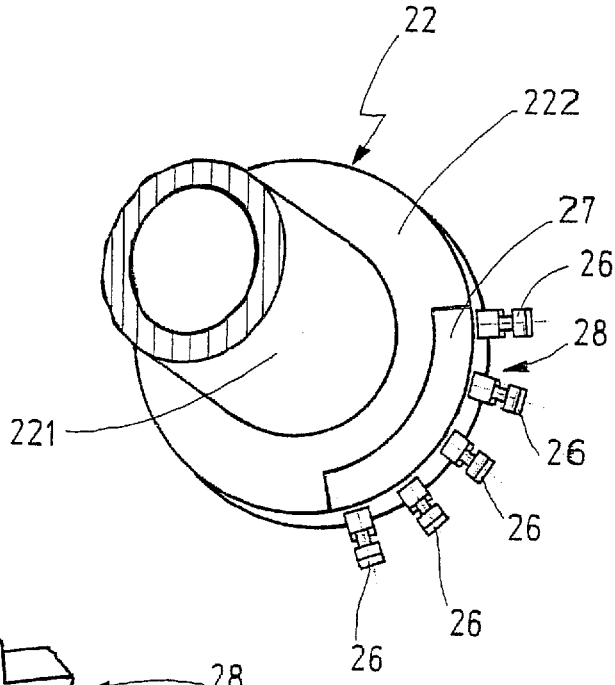
Figure 3:
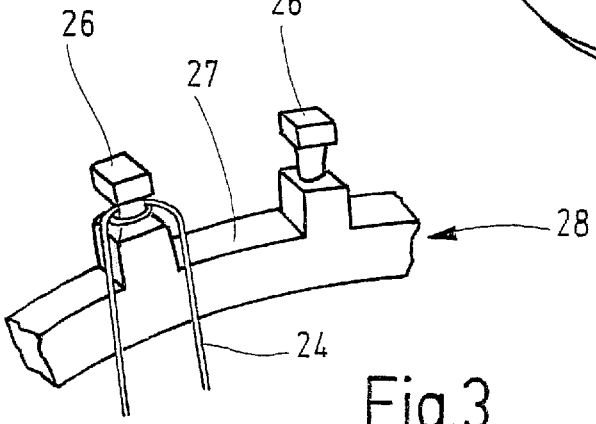
Figure 4:
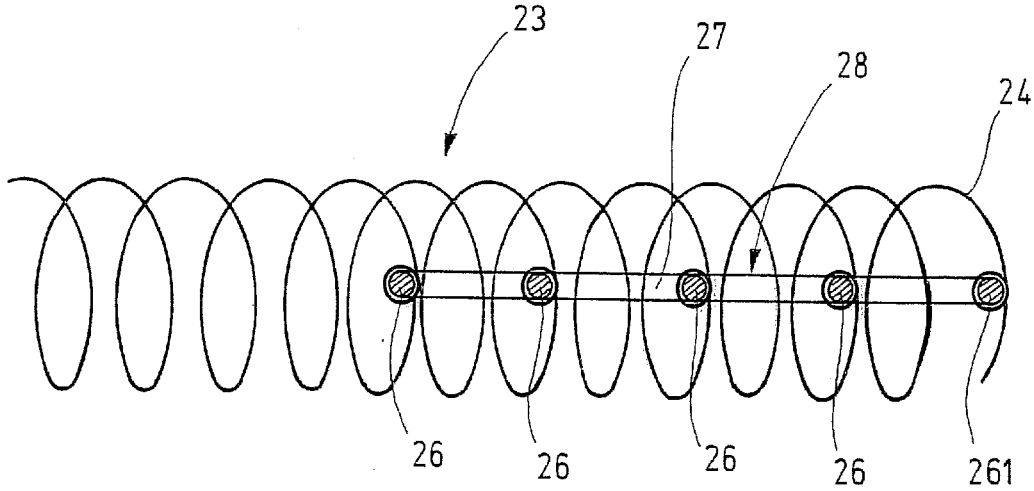
Figure 5:
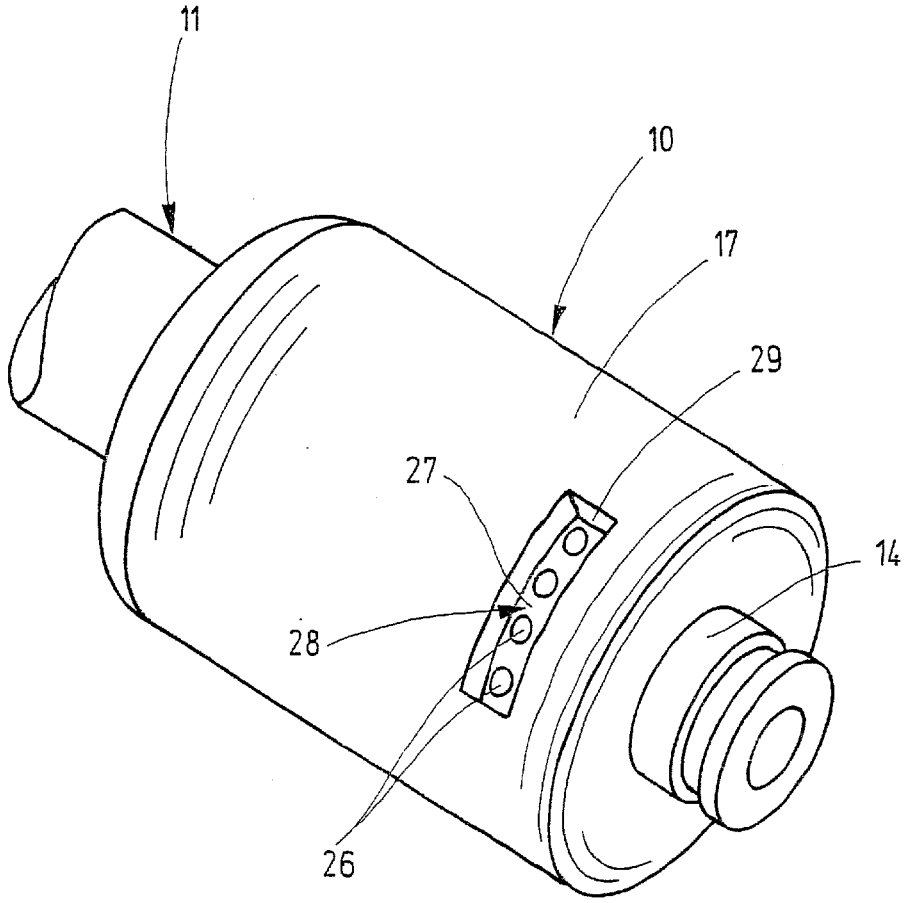

The invention is described in further detail below in terms of an exemplary embodiment shown in the drawing. Shown are:

FIG. 1, a longitudinal section of an electromagnetically actuated pressure regulating valve for transmission control in automatic transmissions of motor vehicles;

FIG. 2, a fragmentary perspective view of a coil body of the magnet coil of the electromagnet of FIG. 1;

FIG. 3, a perspective view of an enlarged detail of a stanchion strip on the coil body of FIG. 2;

FIG. 4, a schematic view of a portion of the exciter winding of the magnet coil of the electromagnet of FIG. 1, with a stanchion strip of FIG. 2;

FIG. 5, a fragmentary perspective view of the pressure regulating valve of FIG. 1.

DESCRIPTION OF THE EXEMPLARY EMBODIMENT

The pressure regulating valve shown in longitudinal section in FIG. 1 has an electromagnet 10 and a proportional valve, embodied as a 3/3-way valve 11, that is fixed to the face end of the electromagnet 10. The valve terminals are marked P, A and T. They are controlled by a control slide 12, embodied as a double-piston slide, that is actuated by the electromagnet 10.

The electromagnet 10 has a magnet coil 13, a magnet core 14, a movable armature 16 that is opposed the magnet core 14, leaving an air gap 15, and a housing 17 of ferromagnetic material, which surrounds the magnet coil 13 and the armature 16 and together with the magnet core 14 forms the ferromagnetic circuit of the electromagnet 10. The electromagnet 10 is seated axially nondisplaceably on a slide rod 121 of the control slide 12; the control slide 12 is guided axially displaceably in a central bore 20 of the magnet core 14, on the one hand by one of the control pistons 22 in a central bore 19 in the valve body 18 and on the other by the slide rod 121. A compression spring 21, retained on the slide rod 121, is braced on one end on the magnet core 14 and on the other on the armature 16 and forms a restoring spring for the armature 16 whose spring force is oriented counter to the magnetic force generated by the electromagnet 10, when the electromagnet 10 is not excited, the armature 16 is pressed by the compression spring 21 against a stop in the housing 17; in the exemplary embodiment of FIG. 1, this stop is formed by the valve body 18 of the 3/3-way valve 11, and this valve body is fixed to the housing 17 by being crimped over. A diaphragm 30, fastened on its periphery between the valve body 18 and the housing 17 and joined centrally to the armature 16, seals off the 3/3-way valve 11 from the electromagnet 10.

The magnet coil 13 comprises a coil body 22 and an exciter winding 23, which is received by the coil body 22 and is wound in multiple layers from an insulated winding wire 24, such as copper-coated wire. The plastic injection-molded coil body 22, embodied on the order of a yarn reel, has a cylindrical middle part 221, onto which the exciter winding 23 is wound, and two flanges 222, disposed on the end of the middle part 221, that cover the face ends of the exciter winding 23. The coil body 22 is slipped onto the magnet core 14 and is surrounded by the housing 17. In addition, the entire magnet coil 13 can be spray-coated with a plastic layer 25. Although not shown in further detail here, the beginning and end of the exciter winding 23 are provided with terminal lugs, by way of which the exciter winding 23 is supplied with current.

Because of production variations in the tolerances of the individual components of the electromagnet 10 and fluctuations in the permeability of the ferromagnetic material, its magnetic force within the same production series suffers unavoidable variations, which adversely affect the characteristic curve of the pressure regulating valve. To compensate for these variations in the magnetic force, calibration means are provided on the electromagnet 10, with which a retroactive calibration of the electromagnet 10 in terms of the magnetic force it generates can be performed after the installation of the electromagnet 10 or after the electromagnet 10 has been assembled with the 3/3-way valve 11. These calibration means include a plurality of stanchions 26 of electrically conductive material that project freely and are disposed on the magnet coil 13 and can be melted by means of laser welding, in the process furnishing a sufficiently large melting volume for welding. As illustrated in the schematic view of the exciter winding 23 in FIG. 4, in selected windings of the exciter winding 23 the insulated winding wire 24 is wrapped around each one of the stanchions 26 individually.

As schematically indicated in FIG. 4 and as structurally shown in FIGS. 2 and 3, the electrical connection of the stanchions 26 to one another is brought about by a rib 27, on which the stanchions 26 are formed integrally. The rib 27 and the stanchions 26 form a stanchion strip 28, which is curved in an arc and secured to the coil body 22. As can be seen from the fragmentary view of the coil body 22 in FIG. 2, the stanchion strip 28 is secured to the coil body 22 in that the rib 27 is jointly injected into the flange 222 in the injection molding of the coil body 22; the stanchion strip 28 is oriented such that the stanchions 26 protrude essentially radially from the circumference of the flange 222. The selected windings of the exciter winding 23, in which the winding wire 24 is wrapped individually around each of the stanchions 26, are located in the uppermost winding layer, in the end region of the exciter winding 23; the winding end having the last stanchion 26 in the stanchion strip 28, that is, the stanchion 261 in FIG. 4, can be welded directly during the production of the magnet coil 13. The welding of the stanchion 261 is done by laser action on the stanchion 261, causing the stanchion 261 to melt open and furnish a sufficiently large molten volume so that the winding wire 24 is reliably connected electrically conductively to the stanchion 261, through the winding wire insulation.

In the last winding portion of the exciter winding 23, shown schematically in FIG. 4, there is only a single winding between each winding in which the winding wire 24 is wrapped around one stanchion 26. It is understood that the exciter winding 23 can instead be embodied such that between the stanchions 26, there are a plurality of windings or winding packets with different numbers of windings. If the electromagnet 10 is designed for a required magnetic force, then the exciter winding 23 of the magnet coil 13 is embodied with a somewhat larger number of windings than would be theoretically necessary to achieve the required magnetic force, given a suitable supply of current to the magnet coil 13. Once the electromagnet 10 has been put together and optionally after it has been connected to the 3/3-way valve 11, the electromagnet 10 is now calibrated in terms of its magnetic force; a suitable stanchion 26 is melted open by means of a laser beam aimed at it, causing the stanchion 26 and the winding wire 24 to fuse to one another reliably through the wire insulation, creating an electrical connection between the winding portion and the stanchion strip 28. All the windings that are now located between the stanchion 26 treated in this way and the last stanchion 261 in the stanchion strip 28 are short-circuited, and the magnetic force of the electromagnet 10 is decreased in accordance with the reduced number of windings. Melting further stanchions 26 open can reduce the magnetic force in stages, until the desired slope of the characteristic curve of the pressure regulating valve is reached.

To assure access to the stanchions 26 protruding radially from the flange 222 of the coil body 22 after the complete assembly of the electromagnet 10, there is an opening 29—as shown in FIG. 5—in the housing 17, the opening being congruent with the stanchion strip 28, and through which opening all the stanchions 26 are accessible to the laser welding. It is understood that if the magnet coil 13 is spray-coated with plastic, the region of the stanchion strip 28 is excepted from the plastic layer 25. After calibration of the electromagnet 10, the opening 29 is closed with a potting composition, such as an epoxy resin.

The invention is not limited to the exemplary embodiment of the electromagnet 10 described. For instance, it is unnecessary for the windings, in which the winding wire 24 wraps around the stanchions 26 of the stanchion strip 28, to be disposed in the end region of the exciter winding 23. On the contrary, the stanchion strip 28 can be located in any region of the exciter winding 23; at least two stanchions 26 must always be treated by laser welding, in order to connect them electrically conductively to a respective winding of the exciter winding 23. The exciter winding 23 is then always reduced by the number of windings located between the two stanchions 26, so that because of the reduced number of windings of the exciter winding 23, the magnetic force is reduced accordingly.

What is claimed is:

1. An electromagnet, having a magnet coil (14) which has an exciter winding (23) wound from an insulated winding wire (24), having a magnet core (14), having a movable armature (16) opposite the magnet core (14) with an air gap spacing between them, and having a restoring spring (21), engaging the armature (16), the spring force of which is oriented counter to the magnetic force, characterized in that disposed on the magnet coil (14) are a plurality of meltable stanchions (26) of electrically conductive material that are electrically conductively connected to one another, and that in selected windings of the exciter winding (23), the winding wire (24) is wrapped around each one of the stanchions (26) individually.

2. The electromagnet of claim 1, characterized in that one of the stanchions (26), preferably the stanchion (261), which in the winding course is associated with the first or last winding encompassing a stanchion (26), is electrically conductively welded to the winding portion wrapping around it, through the wire insulation thereof.

3. The electromagnet of claim 2, characterized in that the winding portion welded to the stanchion (261) forms the winding end of the exciter winding (23).

4. The electromagnet of claim 2, characterized in that at least one selected further stanchion (26) is welded electrically conductively to the winding portion wrapping around it, through the wire insulation thereof.

5. The electromagnet of claim 4, characterized in that the exciter winding (23) is embodied with a number of windings that is greater than the number of windings calculated for a requisite magnetic force.

6. The electromagnet of claim 1, characterized in that the stanchion (26) is combined, via a rib (27) of electrically conductive material integrally joined to each stanchion (26), to form a stanchion strip (28).

7. The electromagnet of claim 6, characterized in that the magnet coil (14) has a coil body (22) that carries the exciter winding (23), and that the stanchion strip (28) is retained on the coil body (22).

8. The electromagnet of claim 6, characterized in that the rib (27) of the stanchion strip (28) is injection-molded into the coil body (22).

9. The electromagnet of claim 8, characterized in that the coil body (22) is embodied like a yarn reel, with a cylindrical middle part (221) that receives the exciter winding (23) and with two flanges (222), each disposed on one end of the middle part (221) and covering the face ends of the exciter winding (23); and that the rib (27) of the stanchion strip (28) is injection-molded into one flange (222) in such a way that the stanchions (26) on the flange circumference protrude essentially radially freely.

10. The electromagnet of claim 9, characterized in that the exciter winding (23) is embodied in multiple layers, and the windings wrapping around the stanchions (26) are located in the uppermost layer, in the end region of the exciter winding (23).

11. The electromagnet of claim 6, characterized in that the magnet coil (13) is surrounded by a housing (17); and that in the housing (17), there is an opening (29) that is congruent with the stanchion strip (28).

12. The electromagnet of claim 11, characterized in that the opening (29) is closed with a potting composition.

13. The electromagnet of claim 1, characterized by its use in an electromagnetic actuator, preferably a proportional pressure regulating valve (11), for transmission control in motor vehicles, in that the armature (16) is secured to an actuating tappet, preferably a valve slide (12) of the proportional pressure regulating valve (11).

* * * * *